United States Patent [19]

Meyer

[11] Patent Number: 4,593,966

[45] Date of Patent: Jun. 10, 1986

[54] MODULAR TELEPHONE LINE COUPLER

[75] Inventor: Daniel Meyer, Hector, Minn.

[73] Assignee: Communications Systems, Inc., Hector, Minn.

[21] Appl. No.: 650,689

[22] Filed: Sep. 17, 1984

[51] Int. Cl.[4] ..... H01R 13/502

[52] U.S. Cl. ..... 339/205; 339/210 M

[58] Field of Search ..... 339/205, 206 R, 206 P, 339/210 R, 210 M

[56] References Cited

U.S. PATENT DOCUMENTS

| | | | |
|---|---|---|---|
| 3,022,485 | 2/1962 | Buchanan | 339/210 R |
| 3,273,105 | 9/1966 | Klassen | 339/210 R |
| 3,332,053 | 7/1967 | Busler | 339/210 R |
| 3,548,367 | 12/1970 | Bruetsch | 339/205 |
| 3,860,316 | 1/1975 | Hardesty | 339/91 R |
| 4,153,327 | 5/1979 | Johnson | 339/205 |
| 4,268,109 | 5/1981 | Hardesty | 339/205 |
| 4,273,402 | 6/1981 | Hughes | 339/205 |
| 4,367,908 | 1/1983 | Johnston | 339/205 |
| 4,379,609 | 4/1983 | Hardesty | 339/205 |
| 4,437,725 | 3/1984 | Eaby et al. | 339/205 |
| 4,460,234 | 7/1984 | Bogese | 339/205 |

*Primary Examiner*—Gil Weidenfeld
*Assistant Examiner*—Thomas M. Kline
*Attorney, Agent, or Firm*—Kinney & Lange

[57] ABSTRACT

A modular coupler is used to interconnect two modular plug-ended telephone line cords. The coupler includes a first and a second section, each having a base and side walls extending along a length. The first section includes a center wall extending in a width direction between the side walls. A plurality of slots are oriented in a lengthwise direction across the center wall. The second section includes first and second forming walls extending in a width direction and separated by an aperture of sufficient size to receive therebetween the center wall of the first section. A plurality of slots extend in a lengthwise direction across the first and second forming walls and slope inward toward the aperture. A plurality of wires are positioned within the slots of the first and second forming walls. During assembly, the center wall is moved between the first and second forming walls to bend the wires toward the first section while clamping them within the coupler. Once assembled, the first and second sections snap together and form two back-to-back hollow jacks opening out opposite ends of the coupler, each for receiving a plug or jack on the end of a line to be coupled to another line. The plugs and lines are electrically interconnected by the wires in the coupler.

16 Claims, 7 Drawing Figures

MODULAR TELEPHONE LINE COUPLER

BACKGROUND OF THE INVENTION

1. Field of the Invention

The present invention relates to communication line coupling devices. In particular, the invention is a modular coupler for interconnecting two modular plug-ended telephone lines.

2. Description of the Prior Art

The use of modular couplers for interconnecting elements of a telephone set is becoming increasingly popular. This arrangement is especially popular with residential users who will typically have wall mounted modular jacks located in several rooms of the house.

Individual telephone sets are interconnected to the jack by means of a line cord terminated in a modular plug. U.S. Pat. No. 3,860,316 discloses a modular plug suitable for this purpose. The modular plug is easily inserted or removed from the jack yet provides positive electrical interconnections. The telephone set is therefore easily moved from room to room within the home.

The ever increasing popularity of modular couplers has created a demand for coupling devices capable of interconnecting line cords which have both ends terminated in modular plugs. A coupler of this type would, for instance, be useful for interconnecting and extension line cord between the wall mounted jack and the telephone set.

U.S. Pat. No. 4,268,109 discloses one such coupler. This coupler uses wire-like contact elements which must be performed prior to insertion into the coupler assembly. Other couplers use a subassembly in which the wires are first mounted and formed. The subassembly is then assembled into other sections to form the coupler.

There is a continuing need for couplers that are inexpensive and easy to manufacture. The assembly process should require a minimum of steps and be easy to implement. This goal is facilitated by eliminating the need for subassemblies or preforming of the wire contact elements. The coupler must, however, be capable of securely holding the modular plugs and providing positive electrical interconnections between them.

SUMMARY OF THE INVENTION

The present invention is a modular coupler for interconnecting two modular plug-ended telephone lines. The coupler is formed of dielectric material and is simple and inexpensive to manufacture. Wire contact elements are formed to proper shape by the coupler itself during assembly.

The coupler includes a first section having a center wall extending in a transverse or width direction relative to the longitudinal axis of the coupler. A second section has first and second forming walls also extending in a width direction. The forming walls are spaced apart longitudinally to form an aperture of size to receive therebetween an end portion of the center wall of the first section. A plurality of electrical contact elements comprising lengths of straight wire are positioned parallel to each other over the center wall and across the first and second forming walls. The contact elements extend in a lengthwise direction along the first and second sections. During assembly, the center wall of first section will project between the first and second forming walls of the second section to clampingly hold the plurality of contact elements. The contact elements are bent over the center wall as the first and second sections are moved together and outer end portions of the contact elements extend toward opposite ends of the first section. Means for retaining the first and second sections in an assembly are included. Once assembled, the first and second sections form at the opposite ends two hollow cavities in which the end plugs of two modular plug-ended lines are secured and electrically interconnected by the contact elements.

In the preferred embodiment of the coupler, the center wall of the first section and the first and second forming walls of the second section include a plurality of parallel slots extending in the length direction. The slots are used to position the contact elements.

The slots in the first and second forming walls slope inward toward the aperture separating the walls. The first section also includes a base with a plurality of grooves extending in a lengthwise direction from both sides of the center wall. The grooves in the base are adapted to receive outer ends of the contact elements after the elements are bent by the walls. Clip means hold the first and second sections together.

DETAILED DESCRIPTION OF THE PREFERRED EMBODIMENTS

Figure 1:
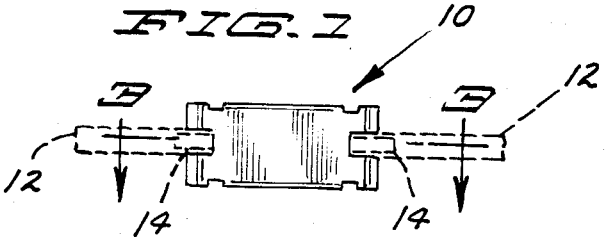
FIG. 1 is a bottom view of the coupler of the present invention.
Figure 2:
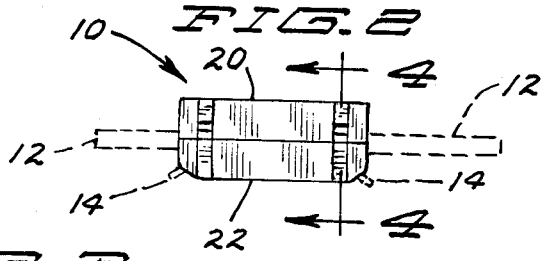
FIG. 2 is a side view of the coupler.

Coupler 10 of the present invention is illustrated generally in FIGS. 1 and 2. Coupler 10 is designed to electrically interconnect two modular plug-ended lines. Plug-ended lines of this type are commonly-used for interconnecting a telephone to a wall mounted jack or for connecting other communication lines. The plug (shown in broken lines in FIG. 3) has a plurality of metal contacts, typically four or six, which are parallel to each other and spaced apart by dielectric slots. The plug will be formed around an end of line 12. Line 12 will include several individual wires which are electrically connected to the metal contacts. The plugs are retained within coupler 10 by snaps 14.

As shown in FIG. 2, coupler 10 is comprised of a first section 20 and a second section 22. First and second sections 20 and 22, respectively, are formed of a dielectric material to prevent unwanted electrical interconnections. Plastics of various types have been successfully used. They enable coupler 10 to be easily and inexpensively manufactured.

Figure 5:
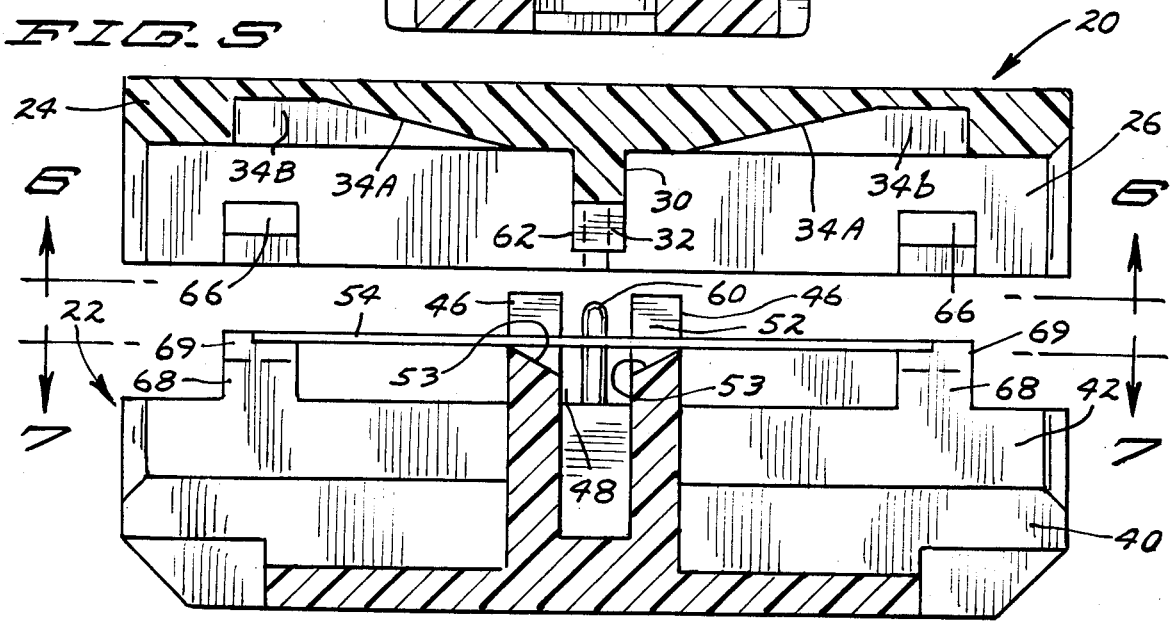
FIG. 5 is an exploded view showing first and second sections of the coupler in position about to be assembled to form contact wires or elements into final configuration as the parts move together.
Figure 6:
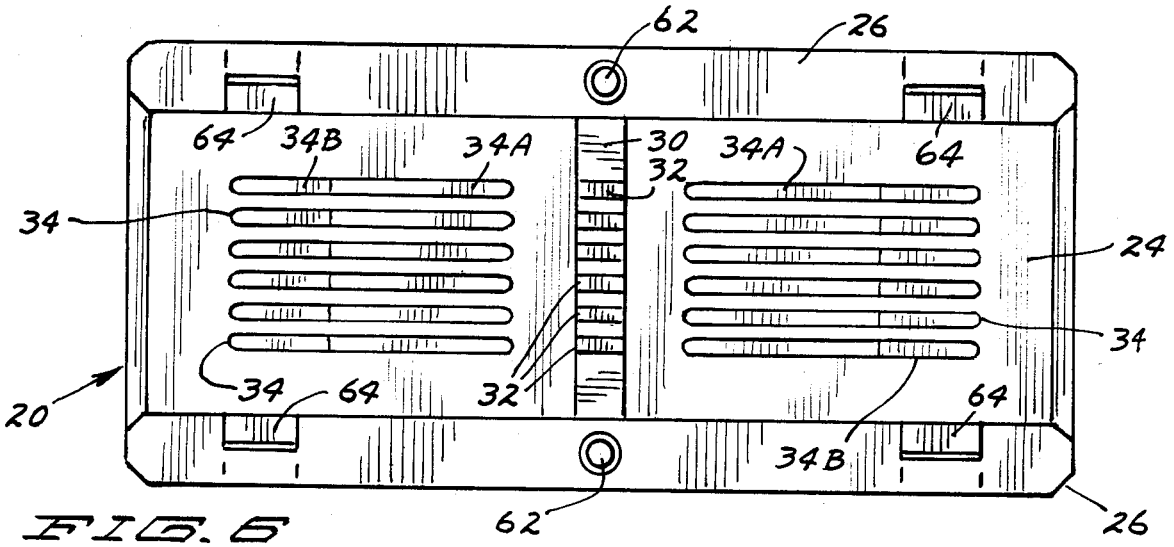
FIG. 6 is a view taken on line 6—6 in FIG. 5 showing the interior of a first section of the coupler.

An interior of first section 20 is best illustrated by FIGS. 5 and 6. Included is a base 24. Side walls 26 are positioned on opposite sides and extend along the length of base 24. A center wall 30 extends across the width near a center of base 24. As shown in FIG. 6, center wall 30 includes a plurality of slots 32 (six are shown) which extend across the wall in a lengthwise direction. These slots are parallel to each other and evenly spaced.

Base 24 also includes a plurality of grooves 34. Grooves 34 are parallel to one another and positioned in alignment with slots 32 on both sides of center wall 30. Grooves 34 also extend in a lengthwise direction along base 24. As best illustrated in FIG. 5, each groove 34 includes a sloping portion 34A and a constant depth portion 34B. Sloping portion 34A slopes downward into base 24 away from center wall 30. Constant depth portion 34B is at a constant depth within base 24.

Figure 7:
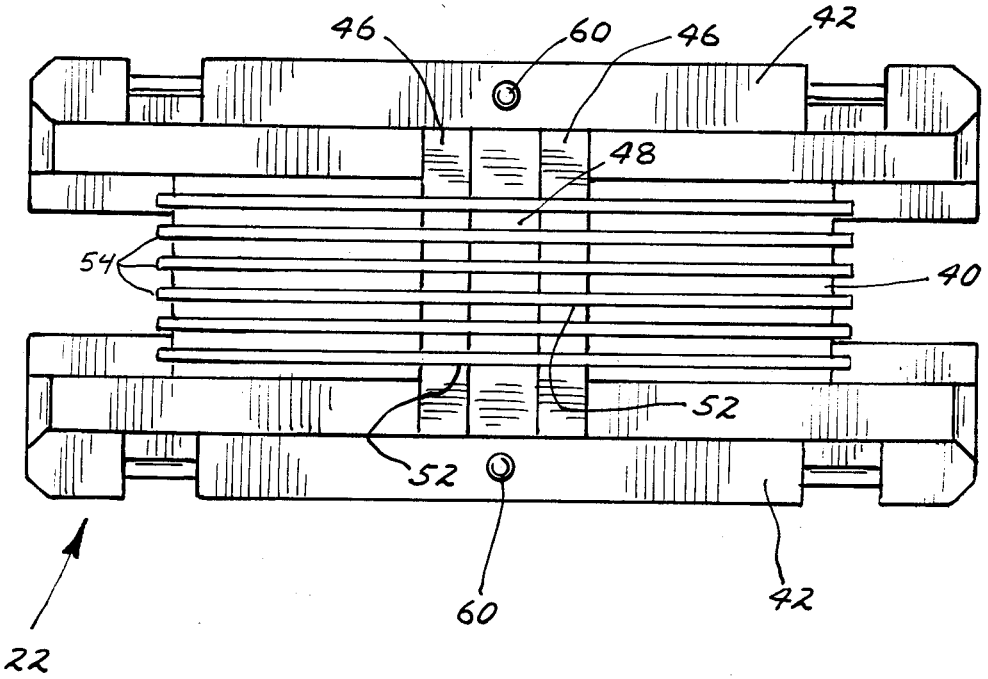
FIG. 7 is a view taken on line 7—7 in FIG. 5 showing the interior of a second section of the coupler.

An interior of second section 22 of coupler 10 is best illustrated by FIGS. 5 and 7. Second section 22 includes a base 40 with side walls 42 positioned on opposite sides and extending along a length of base 40. Also included are forming walls 46 which extend across a width of base 40 on opposite sides of a center. Forming walls 46 are separated by aperture 48. Aperture 48 must be of a sufficient size to receive center wall 30 of first section 20 when coupler 10 is assembled.

Each forming wall 46 includes a plurality of slots 52 which are parallel to one another and extend along the walls in a lengthwise direction with respect to base 40. The slots on the walls align longitudinally with corresponding slots on the other walls. As best shown in FIG. 5, slots 52 have inner surfaces 53 which slope inward towards aperture 48.

A preferred embodiment of coupler 10 utilizes a guide pin and receptacle combination to ensure proper alignment of first and second sections 20 and 22, respectively, during assembly. As shown in FIGS. 5 and 7, guide pins 60 extend from side walls 42 of the second section 22. Receptacles 62, as shown in FIGS. 5 and 6, are formed within side walls 26 of first section 20. Receptacles 62 are positioned to ensure proper alignment of first and second sections 20 and 22, respectively, when guide pins 60 are fit therein.

A preferred method of holding first and second sections 20 and 22 in an assembly is also shown in the figures. As shown in FIG. 6, side walls 26 of first section 20 each include a plurality of channels 64 (two are shown) on an inner side. As shown in FIG. 5, each channel is terminated with an opening 66 which extends all the way through the respective wall. Also shown in FIG. 5 are clips 68 which extend from side walls 42 of second section 22. Each clip 68 is aligned to slide into a respective channel 64 of first section 20. The clips 68 have snap lugs 69 at the upper ends which form latch surfaces which snap into openings 66 when coupler 10 is assembled.

Figure 3:
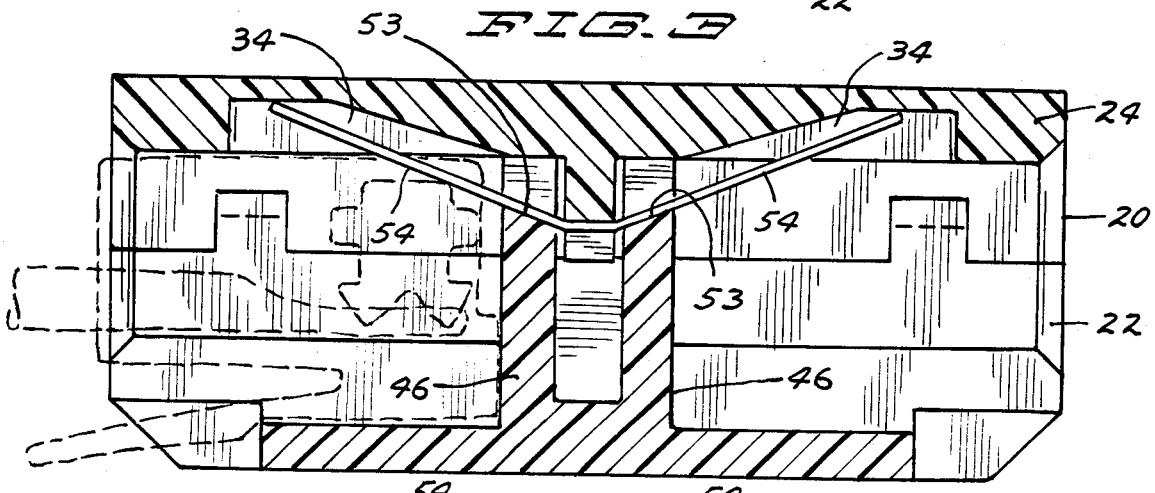
FIG. 3 is cross sectional view of the coupler taken on line 3—3 in FIG. 1.

The two sections of the coupler 10 are assembled in sequence as shown in FIG. 5. A separate contact element, such as a straight length of gold-plated wire 54, is positioned within each of slots 52 of second section 22. FIG. 5 shows the placement of one wire 54 and FIG. 7 shows all of the wires in position. The wires are supported on both walls 46 and span the aperture 48. With center wall 30 aligned to be positioned between forming walls 46, as shown in FIG. 5, first section 20 is moved toward second section 22. As shown in FIG. 3, center wall 30 has a height so that the end of wall 30 will bear against the wires 54 and against forming walls 46 when the sections are joined. When first and second sections 20 and 22, respectively, are moved together, the pins 60 and receptacles 62 guide the sections together and center wall 30 causes wires 54 to bend against the inner surfaces 53 of slots 52 within forming walls 46. Outer ends of wires 54 bend at the angles of surface 53 toward base 24 of first section 20 and are received by grooves 34. Wires 54 are further formed by sloping portion 34A of grooves 34 as coupler 10 is assembled. Center wall 30 of first section 20 clampingly supports wires 54 within forming walls 46 of second section 22.

Figure 4:
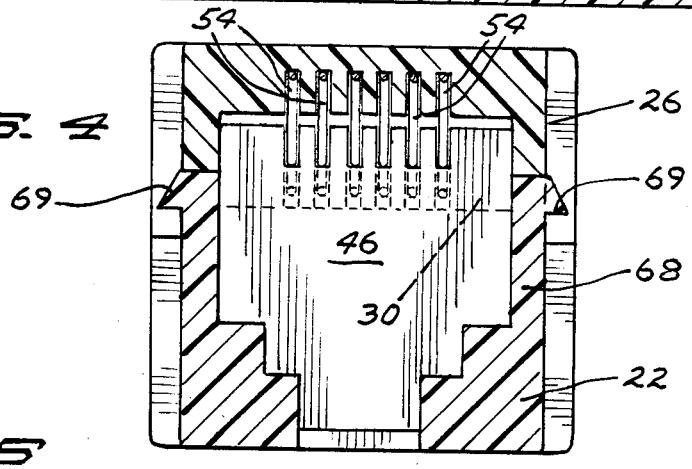
FIG. 4 is a sectional view taken on line 4—4 in FIG. 2.

Once assembled, the lugs 69 of clips 68 of second section 22 will snap into openings 66 in first section 20. First and second sections 20 and 22 are thereby held together to form coupler 10. Although this is a preferred method, other types of fastening will also work. Coupler 10 forms two longitudinal back-to-back cavities, one on each end of the coupler. The profile of one such cavity and the orientation of wires 54 therein is illustrated by FIG. 4. The cavity will be of a shape adapted to receive a modular plug in such a way that its metal contacts will be electrically interconnected with wires 54. The cavity will also be adapted to fixedly hold the modular plug therein. Snap-type clips are typically included on the plug for this purpose.

To summarize, the present invention is a coupler which is very easy to manufacture and assemble. As shown in FIG. 5, straight lengths of wire are laid in place on second section 22. First section 20 is then pushed into place and held by clips formed on the sections themselves. This assembly can be performed quickly and reliably with automated manufacturing equipment. Time consuming subassembly steps, such as preforming of the wires, are not required.

Although the present invention has been described with reference to preferred embodiments, workers skilled in the art will recognize that changes may be made in form and detail without departing from the spirit and scope of the invention.

What is claimed is:

1. A modular coupler for interconnecting two modular plug-ended lines comprising:

a first section having a center wall extending in a widthwise direction;

a second section having first and second forming walls extending in a widthwise direction and spaced apart to form an aperture of a size to receive therebetween and center wall of the first section;

a plurality of electrical contact elements positioned parallel to each other over the center wall and the first and second forming walls and extending in a lengthwise direction with respect to the first and second sections; and means to retain the first and second sections in an assembly, the center wall of the first section projecting between the first and second forming walls of the second section to clampingly hold the plurality of contact elements, the contact elements being bent over the center wall and extending toward opposite ends of the assembly, the first and second sections forming at the opposite ends two hollow cavities for securing the two modular plug-ended lines which are electrically interconnected by the plurality of contact elements.

2. The coupler of claim 1 and including a plurality of slots in the center wall of the first section, the slots being parallel to each other and extending in a lengthwise direction with respect to the first section and used to position the plurality of contact elements.

3. The coupler of claim 2 and including a plurality of slots in the first and second forming walls of the second section, the slots being parallel to each other and extending in a lengthwise direction with respect to the second section and used to position the plurality of contact elements.

4. The coupler of claim 1 wherein the first section includes a base having a plurality of grooves extending in a lengthwise direction from both sides of the center wall to receive outer ends of the bent contact elements.

5. The coupler of claim 4 wherein the grooves in the base of the first section slope downward into the base away from the center wall.

6. The coupler of claim 3 wherein the slots in the first and second forming walls slope inward toward the aperture separating the walls.

7. The coupler of claim 1 and including means to guide the first and second sections together.

8. The coupler of claim 1 and including clip means to retain the first and second sections in an assembly.

9. A modular coupler for interconnecting two modular plug-ended lines comprising:

a first section including:

a first base;

first and second outer walls positioned on opposite sides and extending in a lengthwise direction with respect to the first base;

an inner wall extending in a widthwise direction between the first and second outer walls;

a second section having:

a second base;

third and fourth outer walls positioned on opposite sides and extending in a lengthwise direction with respect to the second base;

first and second forming walls extending in a widthwise direction between the third and fourth outer walls and spaced apart by an aperture of a size to receive therebetween the inner wall of the first section;

a plurality of wires positioned parallel to each other across the inner wall of the first section and the first and second forming walls of the second section; and means to retain the first and second sections in an assembly, the inner wall and the first and second forming walls projecting from the respective bases sufficiently so that the inner wall extends between the first and second forming walls to clampingly hold the plurality of wires, the wires being bent over the inner wall and extending toward the first base and toward opposite ends of the assembly, the first and second sections forming two hollow cavities at the opposite ends when assembled for securing the two modular plug-ended lines with the plurality of wires electrically interconnecting them.

10. The coupler of claim 9 and including a plurality of slots in the inner wall of the first section, the slots being parallel to each other and extending in a lengthwise direction with respect to the first base and used to position the plurality of wires.

11. The coupler of claim 10 and including a plurality of slots in the first and second forming walls of the second section, the slots being parallel to each other and extending in a lengthwise direction with respect to the second base and used to position the plurality of wires.

12. The coupler of claim 9 and including a plurality of grooves in the first base which extend in a lengthwise direction on both sides of the inner wall and receive outer ends of the bent wires.

13. The coupler of claim 12 wherein the grooves in the first base slope downward into the base away from the inner wall.

14. The coupler of claim 11 wherein the slots in the first and second forming walls slope inward toward the aperture separating the walls.

15. The coupler of claim 9 and including guide means for aligning the first and second sections.

16. The coupler of claim 9 and including snap means to retain the first and second sections in an assembly.

* * * * *